United States Patent [19]

Molter

[11] Patent Number: 4,921,585

[45] Date of Patent: May 1, 1990

[54] ELECTROLYSIS CELL AND METHOD OF USE

[75] Inventor: Trent M. Molter, Enfield, Conn.

[73] Assignee: United Technologies Corporation, Hartford, Conn.

[21] Appl. No.: 331,466

[22] Filed: Mar. 31, 1989

[51] Int. Cl.[5] ..... C25B 3/00; C25B 9/00

[52] U.S. Cl. ..... 204/72; 204/263

[58] Field of Search ..... 204/72, 77, 263, 265, 204/266

[56] References Cited

U.S. PATENT DOCUMENTS

| | | | |
|---|---|---|---|
| 3,585,079 | 6/1971 | Richter et al. | 136/86 A |
| 3,773,878 | 11/1973 | Jahnke | 264/49 |
| 3,992,271 | 11/1976 | Danzig et al. | 204/129 |
| 4,179,350 | 12/1979 | Deborski | 204/284 |
| 4,187,350 | 2/1980 | McIntyre et al. | 429/45 |
| 4,252,875 | 2/1981 | Venkatasetty | 429/196 |
| 4,294,608 | 10/1981 | Sedlak et al. | 75/0.5 |
| 4,380,576 | 4/1983 | Yoshida et al. | 429/27 |
| 4,405,693 | 9/1983 | Doddapaneni | 429/101 |
| 4,407,907 | 10/1983 | Takamura et al. | 429/42 |
| 4,510,214 | 4/1985 | Crouse et al. | 429/43 |
| 4,520,086 | 5/1985 | Skotheim | 429/192 |
| 4,556,614 | 12/1985 | le Mehaute et al. | 429/191 |
| 4,584,251 | 4/1986 | Hunziker | 429/191 |
| 4,609,441 | 9/1986 | Frese, Jr. et al. | 204/77 |
| 4,710,437 | 12/1987 | Doddapaneni | 429/101 |

OTHER PUBLICATIONS

Ronald Cook, Robert C. MacDuff, Anthony F. Sammells; Ambient Temperature Gas Phase $CO_2$ Reduction to Hydrocarbons at Solid Polymer Electrolyte Cells; Jun. 1988.

Solid Polymer Electrolyte Technology for Carbon Dioxide Removal Reduction; Jan. 1983.

M. Ulman, B. Aurian-Blajeni, M. Halmann; Fuel From $CO_2$: An Electrochemical Study; Apr. 1984; Chem. Tech.

A. H. A. Tinnemans, T. P. M. Koster, D. H. M. W. Thewissen and A. Mackor; Tetraaza-Macrocyclic Cobalt (II) and Nickel (II) Complexes as an Electron--Transfer Agents in the Photo(Electro)Chemical and Electrochemical Reduction of Carbon Dioxide); Mar. 1984.

*Primary Examiner*—T. M. Tufariello

[57] ABSTRACT

The present invention discloses an improved solid polymer electrolysis cell for the reduction of carbon dioxide. The improvement being the use of a cathode having a metal phthalocyanine catalyst which results in the suppression of the formation of hydrogen during the reduction process and the subsequent improved conversion efficiency for carbon dioxide.

9 Claims, 1 Drawing Sheet

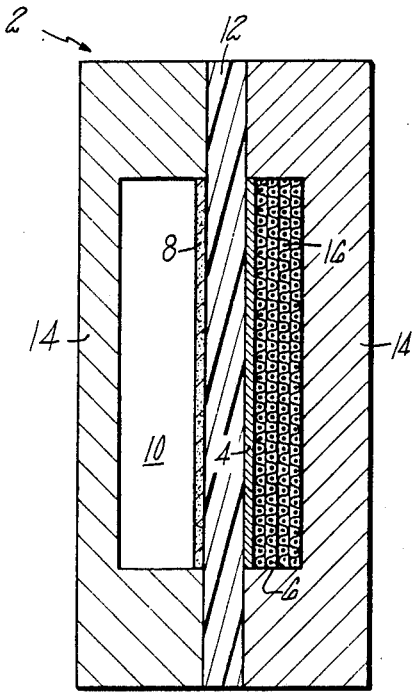
2
12
8
16
14
14
10
4
6

ELECTROLYSIS CELL AND METHOD OF USE

TECHNICAL FIELD

The technical field to which this invention pertains is electrolysis cells in particular electrolysis cells for the reduction of carbon dioxide using a solid polymer electrolyte.

BACKGROUND OF THE INVENTION

The electrochemical reduction of carbon dioxide to produce organic compounds utilizing an electrolysis cell has been known for some time. Such reduction has been carried out in conventional electrolysis cells having an anode, a cathode and an electrolyte. Typically the cells are operated by passing an electric current through the anode and cathode at the same time that an anolyte fuel is brought into contact with the catalyst on the anode and a carbon dioxide containing catholyte is in contact with the catalyst at the cathode. The typical fuel contains hydrogen and is either hydrogen gas or water. One such process is described in U.S. Pat. No. 4,609,441 for the production of methanol, while a second is taught for the production of hydrocarbons in the article entitled: Ambient Temperature Gas Phase CO2 Reduction to Hydrocarbons at Solid Polymer Electrolyte Cells, J.Electrochem. Soc.: Electrochemical Society and Technology, June 1988 p 1470–1471).

A chronic problem associated with operating these devices is that it has not been possible to devise an electrolysis cell which has an adequate conversion efficiency to be of any real commercial value. This is demonstrated in the article cited above where the conversion rate of carbon dioxide to hydrocarbons is less than about 2 percent.

The present invention is directed toward improving the conversion efficiency of these electrolysis cells.

DISCLOSURE OF THE INVENTION

The present invention is directed toward an improved electrolysis cell for the reduction of carbon dioxide wherein said cell comprises an anode, a cathode and a solid polymer electrolyte the improvement comprising a cathode containing one or more metal phthalocyanines.

Further disclosed is an improved method of reducing carbon dioxide using an electrolysis cell having an anode, a cathode and a solid polymer electrolyte wherein the cathode contains one or more metal phthalocyanines.

Further disclosed is an improved electrolysis cell useful in the production of oxygen and the reduction of carbon dioxide.

The foregoing and other features and advantages of the present invention will become more apparent from the following description and drawings.

BRIEF DESCRIPTION OF THE DRAWINGS

The Figure is a cross-sectional view of an electrolysis cell of the present invention.

BEST MODE FOR CARRYING OUT THE INVENTION

Conventional electrolysis cell structures may be used in the practice of this invention. One such conventional configuration is shown in the Figure which contains an electrolysis cell 2 having an anode 4, an anode chamber 6, a cathode 8 and a cathode chamber 10. The anode 4 and the cathode 8 are in electrical contact with a solid polymer electrolyte 12. In addition each chamber contains electrically conductive current distributors 14 as well as optional fluid distribution fields 16 shown in the anode chamber 6 (one may also be present in the cathode chamber as well if desired). Also present are inlet and outlet ports for the introduction and exhaustion of both the anolyte and the catholyte materials and the resulting products of the electrolysis reaction as well as a source of electrical current to the anode and cathode (for simplicity sake these structures are not depicted). A typical electrolysis cell is described in commonly assigned U.S. Pat. No. 3,992,271 the teaching of which is incorporated herein.

The anodes useful in these cells are conventional and will contain conventional catalytic materials and should be formed of conventional materials, such as platinum, ruthenium or iridium, using conventional techniques. In addition, mixtures and alloys of these and other materials dispersed on a high surface area support may also be used. Conventional anodes which are particularly useful are described in commonly assigned U.S. Pat. No. 4,294,608 the teaching of which is incorporated herein and the above mentioned U.S. Pat. No. 3,992,271. The catalyst on the anode should be capable of high reactivity for the half cell reaction $$2H_2O \rightarrow 4H^+ + 4e^- + O_2 \quad (1)$$

The electrolyte may be any of the conventional solid polymer electrolytes useful in fuel cells or electrolysis cells and capable of transporting positive ions (preferably $H^+$) from the anode to the cathode. One type is a cation exchange membrane in proton form such as Nafion (available from DuPont Corporation). Other possible electrolytes may be perfluorocarboxylic acid polymers, available from Asahi Glass and perfluorosulfonic acid polymers available from Dow Chemical. These and other solid polymer electrolyte materials are well known to those skilled in the art and need not be set forth in detail here.

The improvement comprises the selection of the cathode material. It is believed that the presence of metal phthalocyanines at the cathode will improve the conversion efficiency of carbon dioxide in the presence of hydrogen ions to organic compounds. The most prevalent reaction is the reduction of carbon dioxide to formic acid set forth below $$CO_2 + 2H^+ + 2e^- \rightarrow HCOOH \quad (2)$$

However, several other reactions may also be enhanced through the use of this cathode such as production of methanol, formaldehyde, glycolic acid, and methane. One or more of these materials will be generated at the cathode depending on the current density at which the cell is operated and other operating parameters of the electrolysis cell including the reactants.

Although it is believed that any metal phthalocyanine may be used in this invention the preferred materials are copper, iron, nickel and cobalt phthalocyanine with the most preferred being nickel phthalocyanine.

The metal phthalocyanines should have a formula as set forth below

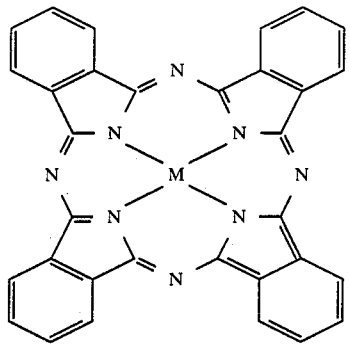

wherein M is a metal ion such as copper, iron, nickel or, cobalt.

The cathode containing the metal phthalocyanine may be formed using conventional techniques and can be applied to the electrolyte membrane in the conventional manner using heat and pressure.

The resulting electrolysis cell should give surprisingly high efficiencies for the conversion of carbon dioxide to organic compounds. These efficiencies for the conversion of carbon dioxide to formic acid are likely to be in excess of 30 percent when the cell is operated using water as the fuel.

It is believed that the improved conversion rate results from the ability of the metal phthalocyanines to suppress the formation of hydrogen gas via the invention reaction $$2H^+ + 2e \rightarrow H_2\,(g) \qquad (3)$$

This is important as free hydrogen ions are necessary for the reduction of the carbon dioxide as may be seen in equation 2. It is believed that this competing reaction (the production of hydrogen gas) is enhanced by those cathode materials having a low hydrogen overvoltage, while the metal phthalocyanines have a high hydrogen overvoltage. (a high hydrogen overvoltage would be one greater than platinum.)

The cathode may be formed of a single metal phthalocyanine or a mixture of metal phthalocyanines. It may even be made using other catalytic materials or noncatalytic materials mixed in with the phthalocyanines. However, these additional catalytic materials (particularly if they have a low hydrogen overvoltage) may enhance the formation of hydrogen gas and therefore reduce the conversion of carbon dioxide. This increase in the production of hydrogen gas would result in the reduced efficiency of carbon dioxide reduction. The catalytic loading levels for these cathodes would likely be from about 0.5 milligrams/cm$^2$ to about 10 milligrams/cm$^2$ of phthalocyanine.

The method of reducing carbon dioxide using the present invention is as follows. The hydrogen containing anolyte is introduced into the anode chamber via an inlet source (not depicted). The anolyte comes in contact with the catalytic anode which is electrically charged. The anolyte undergoes an electrical reaction thereby producing free hydrogen ions. The free hydrogen ions are then transported across the solid polymer electrolyte membrane where they come in contact with the catalytic cathode. At the cathode side of the electrolysis cell a carbon dioxide containing catholyte is introduced into the cathode chamber and is brought into contact with the cathode. At the same time an electrical charge is being passed through the cathode. At the cathode where the hydrogen ions and the carbon dioxide contact the catalytic cathode the desired reaction takes place producing one or the other or a mixture of the products set forth in the specification.

Although the cell may be operated at ambient pressure it would be preferred that the anolyte and the catholyte be introduced and maintained at an elevated pressure. Most preferably the pressure should be greater than 100 psi and even more preferably above 500 psi. The preferred range of pressures would be between about 200 psi to about 1000 psi with about 600 to about 900 psi being the optimum range.

After the reactions have taken place at the anode and the cathode the reaction products and any residual anolyte and catholyte are passed out of the cathode and anode chambers respectively through outlet ports in each chamber (not shown). It is believed that the higher pressures improve the contact between the carbon dioxide and the cathode thereby increasing the chance for a favorable reaction.

The present invention should make the use of these electrolysis devices practical for a number of commercial applications. The most useful of these applications may be found in closed loop environments such as spacecraft, space stations, or undersea habitats. In such environments animals, humans or machinery consume oxygen and produce carbon dioxide. The current invention permits the conversion of such carbon dioxide to an organic fuel i.e., formic acid. The formic acid may then be used to power a fuel cell to produce the electricity to power the electrolysis cell. In addition, it is intended as a primary use that the electrolysis cell be used with water as the fuel. This would permit the electrolytic decomposition of water to form oxygen which could then be consumed by the animals, man, or machinery while supplying the hydrogen ions for the carbon dioxide reduction.

Although the invention has been shown and described with respect to detailed embodiments thereof, it will be understood by those skilled in the art that various changes in form and detail thereof may be made without departing from the spirit and scope of the invention.

I claim:

1. An improved electrolysis cell for the reduction of carbon dioxide having an anode, a cathode and a solid polymer electrolyte the improvement comprising a cathode containing a metal phthalocyanine resulting in the suppression of the formation of hydrogen gas and subsequent improvement in the reduction of carbon dioxide efficiency.

2. The cell of claim 1 wherein the metal phthalocyanine is selected from the group consisting of iron, copper, nickel or cobalt phthalocyanine or mixtures thereof.

3. The cell of claim 1 wherein the metal is nickel.

4. A method for reducing carbon dioxide in an electrolysis cell having an anode a cathode and a solid polymer electrolyte comprising;

contacting the anode with a hydrogen containing material, converting said hydrogen containing material to hydrogen ions, transporting said hydrogen ions through the solid polymer electrolyte to the cathode;

contacting the cathode with carbon dioxide;

thereby causing the carbon dioxide to react with the hydrogen ions to form organic compounds wherein the improvement comprises a cathode comprising a metal phthalocyanine.

5. The method of claim 4 wherein the metal phthalocyanine is selected from the group consisting of iron, copper, nickel, and cobalt phthalocyanine.

6. The method of claim 4 wherein the carbon dioxide material is at a pressure greater than 100 pounds per square inch.

7. The method of claim 4 wherein the carbon dioxide material is at a pressure greater than 500 psi.

8. The method of claim 4 wherein the carbon dioxide material is at a pressure of between 200 and 1000 psi.

9. The method of claim 4 wherein the pressure of the carbon dioxide material in contact with the cathode is about 600 psi to about 900 psi.

* * * * *